US011852131B2

(12) United States Patent
Cluff

(10) Patent No.: US 11,852,131 B2
(45) Date of Patent: Dec. 26, 2023

(54) PRESSURE SAFETY SHUTOFF

(71) Applicant: Carrier Corporation, Palm Beach Gardens, FL (US)

(72) Inventor: Charles A. Cluff, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 486 days.

(21) Appl. No.: 16/649,554

(22) PCT Filed: Sep. 25, 2018

(86) PCT No.: PCT/US2018/052546
§ 371 (c)(1),
(2) Date: Mar. 20, 2020

(87) PCT Pub. No.: WO2019/060871
PCT Pub. Date: Mar. 28, 2019

(65) Prior Publication Data

US 2020/0284251 A1 Sep. 10, 2020

Related U.S. Application Data

(60) Provisional application No. 62/562,929, filed on Sep. 25, 2017.

(51) Int. Cl.
*F04B 49/06* (2006.01)
*F04B 35/04* (2006.01)
(Continued)

(52) U.S. Cl.
CPC ..... *F04B 49/065* (2013.01); *F04B 35/04* (2013.01); *F04B 49/022* (2013.01); *F04B 49/08* (2013.01);
(Continued)

(58) Field of Classification Search
CPC .... F04B 49/022; F04B 49/08; F04B 2205/05; F04C 28/06; F04C 28/28; F04C 2270/185; H01H 35/24
See application file for complete search history.

(56) References Cited

U.S. PATENT DOCUMENTS 3,797,966 A * 3/1974 Randell ..... F04D 15/0066 417/47
4,537,038 A * 8/1985 Alsenz ..... F25B 49/022 62/118
(Continued)

FOREIGN PATENT DOCUMENTS

CN 105276848 A 1/2016
CN 106322860 A 1/2017
(Continued)

OTHER PUBLICATIONS

International Search Report and Written Opinion for application PCT/US2018/052546, 9 pages.

*Primary Examiner* — Christopher S Bobish
(74) *Attorney, Agent, or Firm* — CANTOR COLBURN LLP

(57) ABSTRACT

A high pressure threshold detection circuit (100) is provided. The high pressure threshold detection circuit includes a pressure transducer (110) for measuring a pressure of a medium at an outlet (104) of a compressor (102). The high pressure threshold detection circuit (100) includes a controller (120). The controller (120) includes a comparator (123) and a switch (125). The comparator (123) and the switch (125) are electrically coupled. The switch (125) is electrically coupled to an enable circuit (131). The pressure transducer (110) is electrically coupled to the comparator (123) to provide a signal to the comparator (123) based on the pressure measured at the outlet (104). The comparator (123) outputs a control signal (111) to the switch (125) when
(Continued)

the signal (111) is equal to or greater than a reference value (126). The switch (125) opens the enable circuit (131) to disable compression of the medium by the compressor (102) in response to the control signal (111).

15 Claims, 4 Drawing Sheets

(51) Int. Cl.

| | |
|---|---|
| ***F04B 49/02*** | (2006.01) |
| ***F04B 49/08*** | (2006.01) |
| ***F04C 28/06*** | (2006.01) |
| ***F04C 28/28*** | (2006.01) |

(52) U.S. Cl.
CPC ... *F04B 2203/0204* (2013.01); *F04B 2205/05* (2013.01); *F04C 28/06* (2013.01); *F04C 28/28* (2013.01); *F04C 2270/185* (2013.01)

(56) References Cited

U.S. PATENT DOCUMENTS

| | | | | |
|---|---|---|---|---|
| 4,566,868 | A * | 1/1986 | Menzies | F04B 49/08 417/18 |
| 5,147,392 | A * | 9/1992 | Inagaki | A61M 60/50 600/16 |
| 5,319,945 | A | 6/1994 | Bartlett | |
| 5,454,229 | A | 10/1995 | Hanson | |
| 5,508,655 | A * | 4/1996 | Cederlind | H03K 17/687 327/535 |
| 5,624,237 | A * | 4/1997 | Prescott | E03B 11/00 361/25 |
| 5,673,563 | A | 10/1997 | Albertson et al. | |
| 5,907,957 | A | 6/1999 | Lee et al. | |
| 6,170,277 | B1 | 1/2001 | Porter et al. | |
| 6,497,554 | B2 | 12/2002 | Yang | |
| 6,545,610 | B2 * | 4/2003 | Kurtz | G01L 9/06 340/963 |
| 6,568,416 | B2 | 5/2003 | Tucker et al. | |
| 6,715,996 | B2 * | 4/2004 | Moeller | F04D 15/0227 417/423.1 |
| 6,795,753 | B2 * | 9/2004 | Vanderhoof | F04B 49/022 333/122 |
| 7,326,038 | B2 * | 2/2008 | Iimura | F04B 41/02 417/20 |
| 7,412,842 | B2 | 8/2008 | Pham | |
| 7,476,088 | B2 * | 1/2009 | Iimura | F04B 49/08 417/44.2 |
| 7,600,988 | B2 * | 10/2009 | Doerr | F04D 13/022 280/124.16 |
| 7,752,853 | B2 | 7/2010 | Singh et al. | |
| 8,540,493 | B2 * | 9/2013 | Koehl | F04D 15/0236 417/43 |
| 8,662,235 | B2 | 3/2014 | McNicholas | |
| 8,784,070 | B2 * | 7/2014 | Yokota | F04B 49/065 417/44.2 |
| 9,435,576 | B1 | 9/2016 | Scaringe et al. | |
| 9,518,587 | B2 * | 12/2016 | Yokota | F04B 41/02 |
| 10,677,846 | B2 * | 6/2020 | Guziak | G01R 31/3278 |
| 10,704,546 | B2 * | 7/2020 | Jackson | F04B 49/10 |
| 11,143,177 | B2 * | 10/2021 | Ohata | F04B 49/02 |
| 11,174,857 | B1 * | 11/2021 | Kowalski | F04B 49/022 |
| 11,193,482 | B2 * | 12/2021 | Ren | F04B 49/08 |
| 11,577,282 | B2 * | 2/2023 | Ruttkay | B08B 3/028 |
| 2002/0085929 | A1 * | 7/2002 | Passerini | F04B 49/022 417/307 |
| 2008/0069708 | A1 * | 3/2008 | Beckman | F04B 49/065 417/410.1 |
| 2008/0190493 | A1 | 8/2008 | Oh et al. | |
| 2009/0110567 | A1 * | 4/2009 | Averill | F04B 39/125 417/410.3 |
| 2010/0138049 | A1 | 6/2010 | Creed et al. | |
| 2011/0206538 | A1 * | 8/2011 | Yokota | F04B 49/065 417/1 |
| 2012/0039723 | A1 * | 2/2012 | Gresham | F04B 49/022 417/44.2 |
| 2013/0121843 | A1 | 5/2013 | Dotzenrod et al. | |
| 2013/0153041 | A1 | 6/2013 | Kucera et al. | |
| 2013/0153042 | A1 | 6/2013 | Young et al. | |
| 2017/0046658 | A1 | 2/2017 | Jones et al. | |
| 2017/0232978 | A1 | 8/2017 | Zheng et al. | |
| 2018/0306188 | A1 * | 10/2018 | Van Acker | F04B 49/065 |
| 2020/0211800 | A1 * | 7/2020 | Reese | F04B 49/022 |

FOREIGN PATENT DOCUMENTS

| | | | |
|---|---|---|---|
| CN | 106968930 | A | 7/2017 |
| EP | 2793010 | A2 | 10/2014 |
| EP | 3128171 | A1 | 2/2017 |
| EP | 3199892 | A1 | 5/2017 |
| EP | 3199888 | A1 | 8/2017 |
| JP | H06137648 | A | 5/1994 |
| JP | H10185373 | A | 7/1998 |
| WO | 9748954 | A1 | 12/1997 |
| WO | 2009028465 | A1 | 3/2009 |

* cited by examiner

PRESSURE SAFETY SHUTOFF

BACKGROUND

Typical refrigeration systems require over-pressure protection to prevent damage to system elements or prevent catastrophic burst of pressurized components in the event of a system over-pressure malfunction.

BRIEF DESCRIPTION

In accordance with one or more embodiments, a high pressure threshold detection circuit is provided. The high pressure threshold detection circuit includes a pressure transducer measuring a pressure of a medium at an outlet of a compressor; and a controller including a comparator and a switch, the comparator and the switch being electrically coupled, the switch being electrically coupled to an enable circuit; wherein the pressure transducer is electrically coupled to the comparator to provide a signal to the comparator based on the pressure measured at the outlet, wherein the comparator outputs a control signal to the switch when the signal is equal to or greater than a reference value, and wherein the switch opens an enable circuit to disable compression of the medium by the compressor in response to the control signal.

In accordance with one or more embodiments or the high pressure threshold detection circuit embodiment above, the enable circuit can control operations of a variable-frequency motor drive.

In accordance with one or more embodiments or any of the high pressure threshold detection circuit embodiments above, the variable-frequency motor drive may not provide electrical power to a motor driving the compressor when the enable circuit is open.

In accordance with one or more embodiments or any of the high pressure threshold detection circuit embodiments above, the enable circuit can control a direct connection between line power and a motor driving the compressor.

In accordance with one or more embodiments or any of the high pressure threshold detection circuit embodiments above, the reference value can comprise a pressure threshold not to be exceeded at the outlet.

In accordance with one or more embodiments or any of the high pressure threshold detection circuit embodiments above, the signal can comprise a scaled direct current voltage with low frequency components as the pressure changes.

In accordance with one or more embodiments or any of the high pressure threshold detection circuit embodiments above, the high pressure threshold detection circuit can comprise a control path to disable a variable-frequency motor drive in response to detecting a fault in the pressure transducer.

In accordance with one or more embodiments or any of the high pressure threshold detection circuit embodiments above, the controller can comprise a control diagnostic circuit that monitors in real-time the pressure transducer.

In accordance with one or more embodiments or any of the high pressure threshold detection circuit embodiments above, the controller can comprise a control diagnostic circuit that monitors via contacts operations of the switch and the enable circuit.

In accordance with one or more embodiments or any of the high pressure threshold detection circuit embodiments above, the high pressure threshold detection circuit can utilize a control path to disable a variable-frequency motor drive based on the operations of the switch and the enable circuit.

In accordance with one or more embodiments, a system is provided. The system includes a variable-frequency motor drive providing electrical power; a compressor including an inlet and an outlet; a motor operably coupled to the compressor based on the electrical power from the variable-frequency motor drive; a pressure transducer measuring a pressure of a medium at the outlet of the compressor; a controller operably coupled to the pressure transducer and the variable-frequency motor drive, the controller including a high pressure detection circuit configured to control the variable-frequency motor drive based at least in part on a threshold detection operation.

In accordance with one or more embodiments or the system embodiment above, the variable-frequency motor drive may not provide the electrical power to the motor driving the compressor when the enable circuit is open.

In accordance with one or more embodiments or any of the system embodiments above, the high pressure detection circuit can comprise a comparator electrically coupled to a switch; an enable circuit being electrically coupled to the switch and the variable-frequency motor drive, wherein the pressure transducer can be configured to provide a signal to the comparator based on the pressure measured at the outlet, wherein the comparator can output a control signal to the switch when the signal is equal to or greater than a reference value, and wherein the switch can open the enable circuit to disable compression of the medium by the compressor in response to the control signal.

In accordance with one or more embodiments or any of the system embodiments above, the reference value can comprise a pressure threshold not to be exceeded at the outlet.

In accordance with one or more embodiments or any of the system embodiments above, the signal can comprise a scaled direct current voltage with low frequency components as the pressure changes.

In accordance with one or more embodiments or any of the system embodiments above, the high pressure threshold detection circuit can further comprise a control diagnostic circuit electrically coupled to the pressure transducer and the variable-frequency motor drive, the control diagnostic circuit can be configured to disable the variable-frequency motor drive in response to detecting a fault in the pressure transducer.

In accordance with one or more embodiments or any of the system embodiments above, the high pressure threshold detection circuit can further comprise at least one contact electrically coupled to the switch and the control diagnostic circuit, the contacts can be configured to disable the variable-frequency motor drive in response to detecting a fault in the switch.

In accordance with one or more embodiments, a controller operably coupled to a variable-frequency motor drive providing electrical power to a motor; a compressor including an inlet and an outlet and being operably driver by the motor based on the electrical power from the variable-frequency motor drive; and a pressure transducer measuring a pressure of a medium at the outlet of the compressor. The controller includes a comparator and a switch, the comparator and the switch being electrically coupled, the switch being electrically coupled to an enable circuit; wherein the pressure transducer is electrically coupled to the comparator to provide a signal to the comparator based on the pressure measured at the outlet, wherein the comparator outputs a control signal to the switch when the signal is equal to or greater than a reference value, and wherein the switch opens an enable circuit to disable compression of the medium by the compressor in response to the control signal.

In accordance with one or more embodiments or the controller embodiment above, the variable-frequency motor drive may not provide the electrical power to the motor driving the compressor when the enable circuit is open.

In accordance with one or more embodiments or any of the controller embodiments above, the reference value can comprise a pressure threshold not to be exceeded at the outlet.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
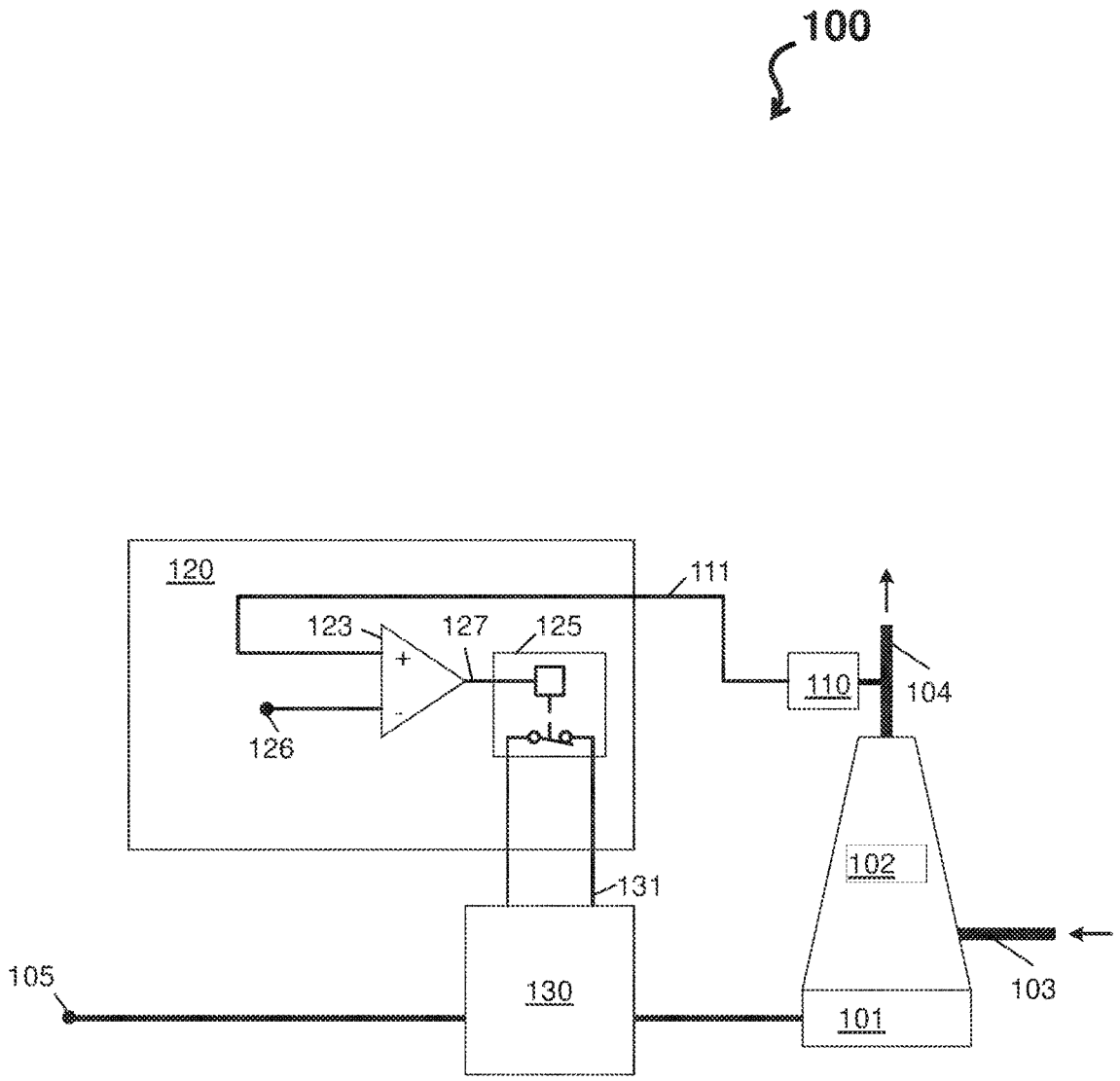
FIG. 1 depicts a pressure safety system according to one or more embodiments.

FIG. 1 depicts a pressure safety system 100 according to one or more embodiments. The pressure safety system 100 can be employed in a refrigeration system. The pressure safety system 100 is an example and is not intended to suggest any limitation as to the scope of use or operability of embodiments described herein (indeed additional or alternative components and/or implementations may be used). Further, while single items are illustrated for items of the pressure safety system 100, these representations are not intended to be limiting and thus, any item may represent a plurality of items.

As shown in FIG. 1, the pressure safety system 100 can comprise a motor 101, a compressor 102 including an inlet 103 and outlet 104, electrical power 105, a pressure transducer 110 providing a signal 111, and a controller 120. The controller 120 can comprise a comparator 123, a switch 125, a reference value 126, and a control signal 127. The pressure safety system 100 can also comprise a variable-frequency motor drive 130 and an enable circuit 131.

The motor 101 can be any electro-mechanical device that utilizes the electrical power 105 to provide mechanical power to the compressor 102. The compressor 102 can be any mechanical device that increases a pressure (pressurizes/compresses) of a medium received at the inlet 103. After compression, the compressor 102 exhausts the medium at the outlet 104.

The pressure transducer 110 can be a device for pressure measurement of gases or liquids (pressure is an expression of the force required to stop a fluid from expanding). The pressure transducer 110 generates the signal 111 (an electrical signal) as a function of the pressure. The signal 111 can be a value reflecting a pressure detected at the outlet 104. In accordance with one or more embodiments, the signal 111 can be a scaled direct current voltage with low frequency components as the pressure changes.

The controller 120 can include any processing hardware, software, or combination of hardware and software utilized by the pressure safety system 100 that carries out computer readable program instructions by performing arithmetical, logical, and/or input/output operations. Examples of the controller 120 include, but are not limited to an arithmetic logic unit, which performs arithmetic and logical operations; a control unit, which extracts, decodes, and executes instructions from a memory; and/or an array unit, which utilizes multiple parallel computing elements.

In accordance with one or more embodiments, the combination of the pressure transducer 110 and the controller 120 can be considered a high pressure threshold detection circuit performing a threshold detection operation, where the pressure transducer 110 provides the signal 111 to the controller 120 to drive a threshold detection operation. The threshold detection operation may be implemented in hardware (analog circuit) and/or software.

The comparator 123 can be an electrical component that compares at least two electrical characteristics, such as voltages or currents to name two non-limiting examples. The comparator 123 compares the electrical characteristics (e.g., the reference value 126 and the signal 111) and outputs a digital signal (e.g., the control signal 127). The reference value 126 can be a value reflecting a pressure threshold that is not to be exceeded at the outlet 104. The reference value 126 can be stored in a memory of the controller 120. The switch 125 can be an electrical component that removes or restores a conducting path in an electrical circuit (e. g., completes or breaks the enable circuit 131). Examples of the switch 125 include, but are not limited to electro-mechanical devices and solid-state switching devices. Thus, to provide the threshold detection operation, the controller 120 operates the comparator 123 based on the reference value 126 and the signal 111 to provide the control signal 127 to the switch 125, so that the enable circuit 131 can allow the variable-frequency motor drive 130 to provide or not provide the electrical power 105 to the motor 101.

In accordance with one or more embodiments, the operations of the comparator 123 can be implemented such that the reference value 126 changes as an output (e.g., the control signal 127) of the comparator 123 changes. For instance, the comparator 123 can use a first value, such as a 680 pound per square inch (PSI) threshold, as the reference value 126, while the pressure detected at the outlet 104 is lower than 680 PSI. And, while the pressure detected at the outlet 104 remains lower than 680 PSI, the control signal 127 of the comparator 123 remains in a first state. When the pressure detected at the outlet 104 exceeds 680 PSI, the control signal 127 of the comparator 123 can change from the first state to a second state. Further, when the pressure detected at the outlet 104 exceeds 680 PSI, the reference value 126 can also change to a second value, e.g., 450 PSI. In this way, the reference value 126 can correspond to one or more reference values based on a current condition of the pressure detected at the outlet 104. A technical effect and benefit of corresponding the reference value 126 to multiple references values is to prevent the pressure safety system 100 from short cycling (requiring an over-pressure to "bleed down" before the pressure safety system 100 can be re-enabled).

The variable-frequency motor drive 130 can be an adjustable-speed drive to control a speed and a torque of the motor 101 by varying a motor input frequency and voltage (e.g., the electrical power). The variable-frequency motor drive 130 can be enabled based on a closing of the enable circuit 131 by the switch 125. In this way, the high pressure threshold detection circuit (e.g., the pressure transducer 110 and the controller 120) can drive a switch output (e.g., the enable circuit 131) that opens when a pressure threshold is matched and/or exceeded and disables compression by the compressor 102 (e.g., turns off the variable-frequency motor drive 130 that supplies the electrical power 105 to the motor 101). In accordance with one or more embodiments, the pressure safety system 100 can comprise a single speed compressor connected through a switch or a contactor) directly to line power, which be in lieu of the variable-frequency motor drive 130.

Figure 2:
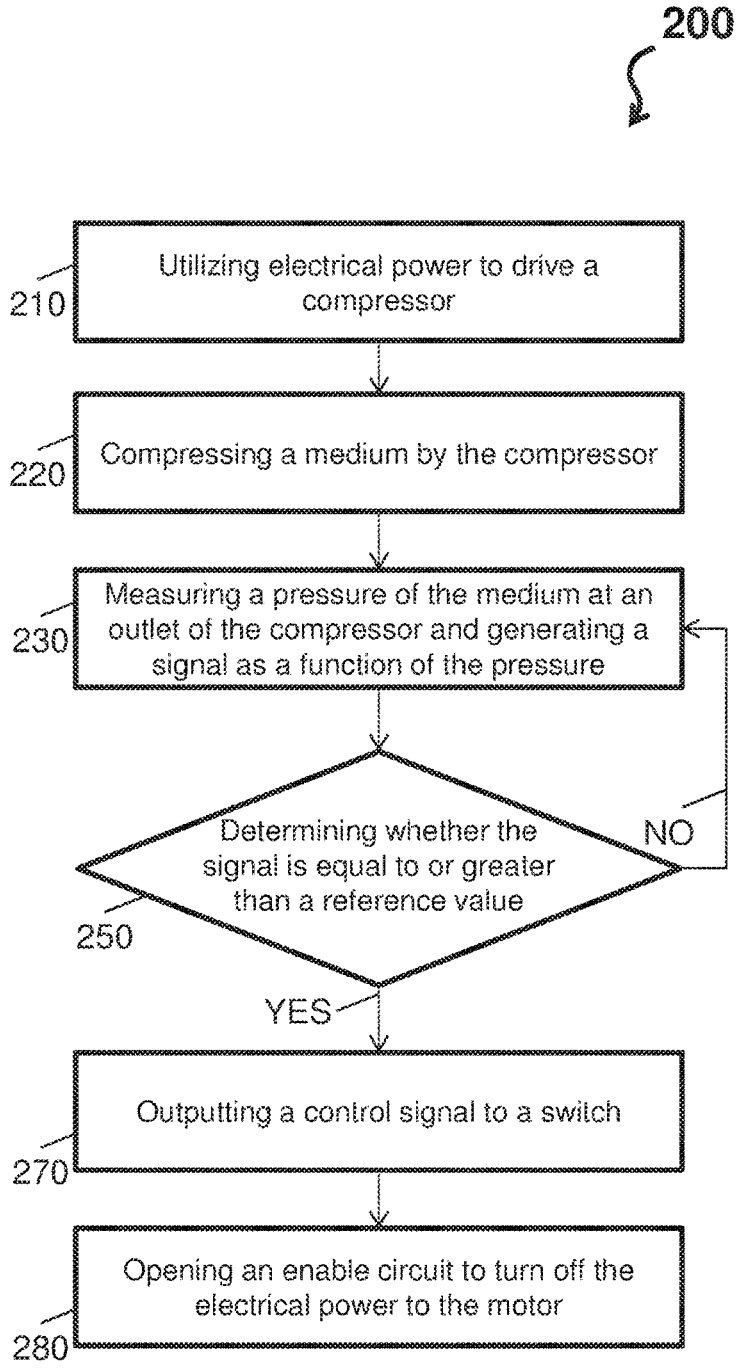
FIG. 2 depicts a process flow of a pressure safety system according to one or more embodiments.

Turning now to FIG. 2, a process flow 200 of the pressure safety system 100 of FIG. 1 is depicted according to one or more embodiments. The process flow 200 is an example of the operations of the pressure safety system 100 to overcome problems arising with respect to the typical refrigeration systems. The process flow 200 begins at block 210, where the motor 101 utilizes electrical power 105 to drive the compressor 102.

At block 220, the compressor 102 compresses a medium (as powered by the motor 101). The medium is received at the inlet 103 in a first pressure state, compressed to a second pressure state, and exhausted in the second pressure state through the outlet 104. The medium can be a substance or mixture, usually a fluid, used as a refrigerant in a heat pump and refrigeration cycle.

At block 230, the pressure transducer 110 measures a pressure of the medium at the outlet 104 and generates the signal 111 as a function of the pressure.

At decision block 250, the comparator 123 compares the signal 111 and the reference value 126 to determine whether the signal 111 is equal to or greater than the reference value 126. If the signal 111 is not equal to or greater than the reference value 126, i.e., when the second pressure state is desirable, the process flow returns to block 230 (as shown by the NO arrow). If the signal 111 is equal to or greater than the reference value 126, the process flow proceeds to block 270 (as shown by the YES arrow).

At block 270, the comparator 123 outputs the control signal 127 to the switch 125 (e.g., when the signal 111 is equal to or greater than the reference value 126). At block 280, in response to the control signal 127, the switch 125 opens the enable circuit 131 to turn off the electrical power 105 to the motor 101 (e.g., to disable compression of the medium by the compressor 102). In accordance with one or more embodiments, the control signal 127 can be outputted with respect to one or more states. For example, the comparator 123 can output the control signal 127 in a first state to the switch 125, when the pressure signal is below the reference value 126. The comparator 123 can also output the control signal 127 in a second state to the switch 125, when the pressure signal is at or above the reference value 126. In this regard, the first state for the control signal 127 can be utilized when the switch 125 is in a closed state, and the first state for the control signal 127 can be utilized when the switch 125 is in an open state. Then the switch 125 can be connected to the enable circuit 131, such that the open state of the switch 125 disables the compression of the medium by the compressor 102.

Figure 3:
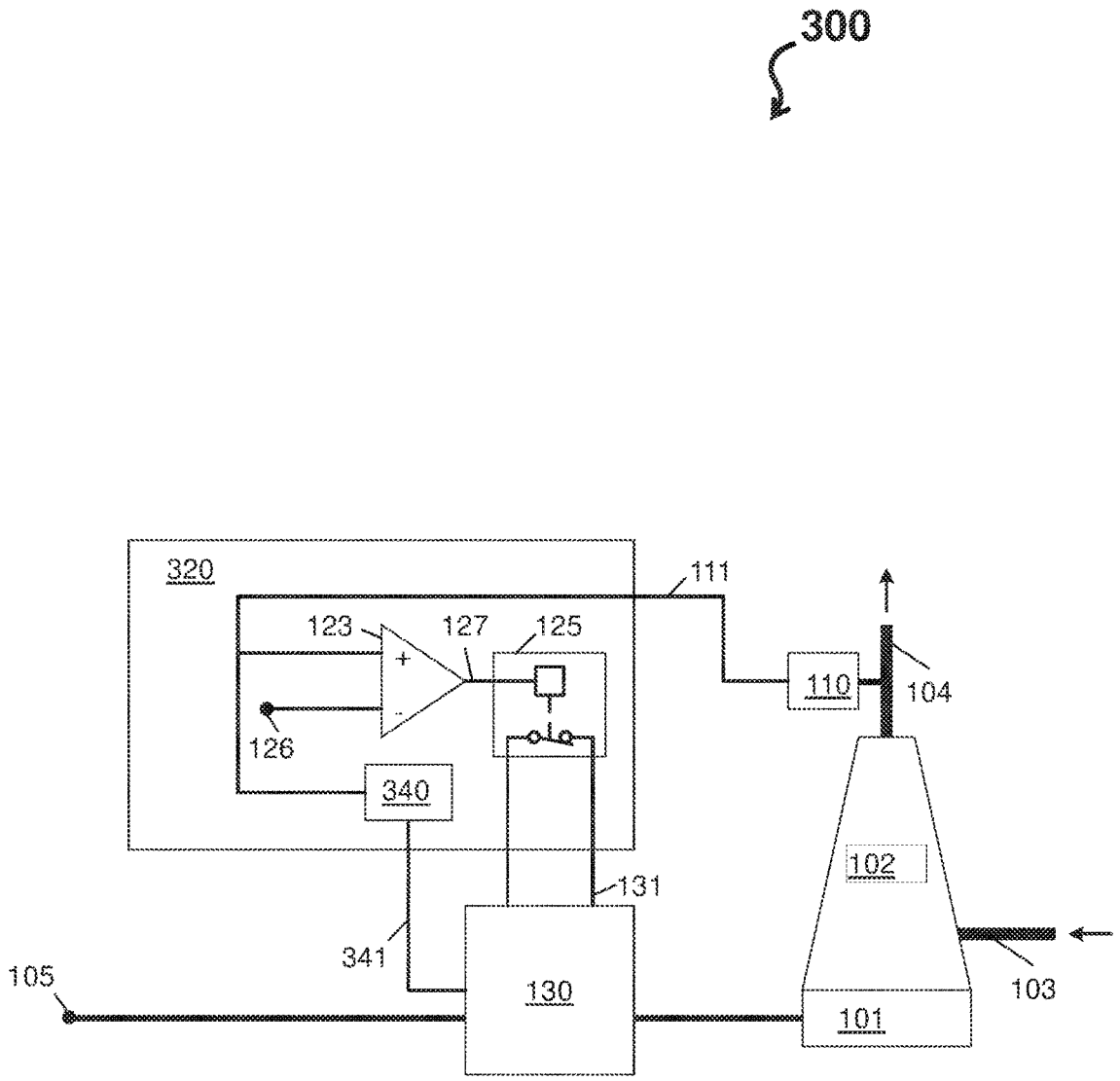
FIG. 3 depicts a pressure safety system according to one or more embodiments.

FIG. 3 depicts a pressure safety system 300 according to one or more embodiments. The pressure safety system 300 is an example and is not intended to suggest any limitation as to the scope of use or operability of embodiments described herein (indeed additional or alternative components and/or implementations may be used). Further, while single items are illustrated for items of the pressure safety system 300, these representations are not intended to be limiting and thus, any item may represent a plurality of items. For ease of explanation, items of the pressure safety system 300 that are similar to the pressure safety system 100 of FIG. 1 are not reintroduced.

As shown in FIG. 3, the pressure safety system 300 includes a controller 320 that includes similar components to the controller 120 of FIG. 1 and further includes a control diagnostic circuit 340. The control diagnostic circuit 340 can be an electrical component that monitors, in real-time, other components of the pressure safety system 300. The control diagnostic circuit 340 can be electrically coupled to components of the pressure safety system 300, such as the pressure transducer 110, to monitor the other components. The control diagnostic circuit 340 can, in turn, provide a secondary control path 341 (e.g., secondary to the enable circuit 131) to disable the variable-frequency motor drive 130. In this way, the pressure safety system 300 provides additional reliability in case of transducer fault detected by the control diagnostic circuit 340. Note that typical pressure safety systems in refrigeration systems are not real-time diagnosable.

Figure 4:
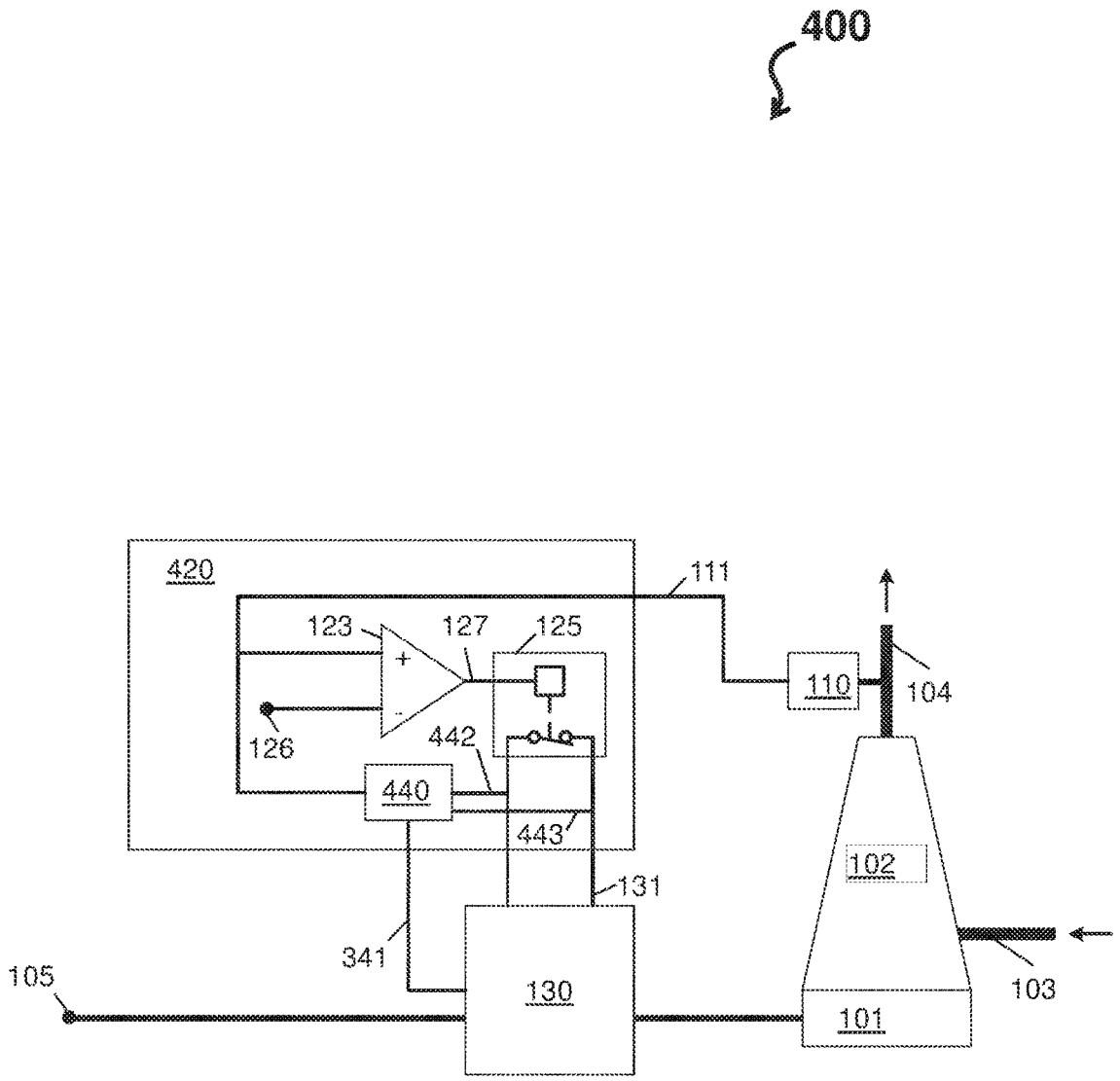
FIG. 4 depicts a pressure safety system according to one or more embodiments.

FIG. 4 depicts a pressure safety system 400 according to one or more embodiments. The pressure safety system 400 is an example and is not intended to suggest any limitation as to the scope of use or operability of embodiments described herein (indeed additional or alternative components and/or implementations may be used). Further, while single items are illustrated for items of the pressure safety system 400, these representations are not intended to be limiting and thus, any item may represent a plurality of items. For ease of explanation, items of the pressure safety system 400 that are similar to the pressure safety system 100 of FIG. 1 and/or the pressure safety system 300 of FIG. 3 are not reintroduced.

As shown in FIG. 4, the pressure safety system 400 includes a controller 420 that includes similar components to the controller 320 of FIG. 3 and further includes a control diagnostic circuit 440. The control diagnostic circuit 440 can be an electrical component that monitors in real-time other components of the pressure safety system 400. For instance, via contacts 422 and 443, the control diagnostic circuit 440 can monitor a cutoff switch state (e.g., operations of the switch 125 and the enable circuit 131) and use the secondary control path 341 to disable the variable-frequency motor drive 130 in case of detected cutoff switch fault.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A high pressure threshold detection circuit of a refrigeration system, comprising:

a pressure transducer measuring a pressure of a medium exiting from an outlet of a compressor of the refrigeration system; and a controller comprising a comparator and a switch, the comparator and the switch being electrically coupled, the switch being electrically coupled to an enable circuit;

wherein the pressure transducer is electrically coupled to the comparator to provide a signal to the comparator based on the pressure measured at the outlet, wherein the comparator outputs a control signal to the switch when the signal is equal to or greater than a first reference value, wherein when the control signal is output, the controller sets a second reference value lower than the first reference value; and wherein the switch opens the enable circuit to disable compression of the medium by the compressor in response to the control signal, the enable circuit open until the signal is less than the second reference value;

wherein the controller comprises a control diagnostic circuit that monitors, via contacts, operations of the switch and the enable circuit; and, wherein the high pressure threshold detection circuit utilizes a control path to disable a variable-frequency motor drive based on a detected fault in operation of the switch.

2. The high pressure threshold detection circuit of claim 1, wherein the enable circuit controls operations of a variable-frequency motor drive.

3. The high pressure threshold detection circuit of claim 2, wherein the variable-frequency motor drive does not provide electrical power to a motor driving the compressor when the enable circuit is open.

4. The high pressure threshold detection circuit of claim 1, wherein the enable circuit controls a direct connection between line power and a motor driving the compressor.

5. The high pressure threshold detection circuit of claim 1, wherein the reference value comprises a pressure threshold not to be exceeded at the outlet.

6. The high pressure threshold detection circuit of claim 1, wherein the signal comprises a scaled direct current voltage with low frequency components as the pressure changes.

7. The high pressure threshold detection circuit of claim 1, wherein the high pressure threshold detection circuit comprises a control path to disable a variable-frequency motor drive in response to detecting a fault in the pressure transducer.

8. The high pressure threshold detection circuit of claim 1, wherein the controller comprises a control diagnostic circuit that monitors in real-time the pressure transducer.

9. A refrigeration system comprising:

a variable-frequency motor drive providing electrical power;

a compressor comprising an inlet and an outlet;

a motor operably coupled to the compressor based on the electrical power from the variable-frequency motor drive;

a pressure transducer measuring a pressure of a medium exiting from the outlet of the compressor;

a controller operably coupled to the pressure transducer and the variable-frequency motor drive, the controller comprising a high pressure detection circuit configured to control the variable-frequency motor drive based at least in part on a threshold detection operation;

wherein the high pressure detection circuit comprises a comparator electrically coupled to a switch;

an enable circuit being electrically coupled to the switch and the variable-frequency motor drive, wherein the pressure transducer is configured to provide a signal to the comparator based on the pressure measured at the outlet, wherein the comparator outputs a control signal to the switch when the signal is equal to or greater than a first reference value, wherein when the control signal is output, the controller sets a second reference value lower than the first reference value; and wherein the switch opens the enable circuit to disable compression of the medium by the compressor in response to the control signal, the enable circuit open until the signal is less than the second reference value;

wherein the high pressure threshold detection circuit further comprises a control diagnostic circuit electrically coupled to the pressure transducer and the variable-frequency motor drive, the control diagnostic circuit configured to disable the variable-frequency motor drive in response to detecting a fault in the pressure transducer;

wherein the high pressure threshold detection circuit further comprises at least one contact electrically coupled to the switch and the control diagnostic circuit, the at least one contact configured to disable the variable-frequency motor drive in response to detecting a fault in the switch.

10. The system of claim 9, wherein the variable-frequency motor drive does not provide the electrical power to the motor driving the compressor when the enable circuit is open.

11. The system of claim 9, wherein the reference value comprises a pressure threshold not to be exceeded at the outlet.

12. The system of claim 9, wherein the signal comprises a scaled direct current voltage with low frequency components as the pressure changes.

13. A controller of a refrigeration system operably coupled to:

a variable-frequency motor drive providing electrical power to a motor;

a compressor comprising an inlet and an outlet and being operably driver by the motor based on the electrical power from the variable-frequency motor drive; and a pressure transducer measuring a pressure of a medium exiting from the outlet of the compressor, wherein the controller comprises a comparator and a switch, the comparator and the switch being electrically coupled, the switch being electrically coupled to an enable circuit;

wherein the pressure transducer is electrically coupled to the comparator to provide a signal to the comparator based on the pressure measured at the outlet, wherein the comparator outputs a control signal to the switch when the signal is equal to or greater than a first reference value, wherein when the control signal is output, the controller sets a second reference value lower than the first reference value; and wherein the switch opens the enable circuit to disable compression of the medium by the compressor in response to the control signal, the enable circuit open until the signal is less than the second reference value;

wherein the controller comprises a control diagnostic circuit that monitors, via contacts, operations of the switch and the enable circuit; and wherein the high pressure threshold detection circuit utilizes a control path to disable a variable-frequency motor drive based on a detected fault in operation of the switch.

14. The controller of claim 13, wherein the variable-frequency motor drive does not provide the electrical power to the motor driving the compressor when the enable circuit is open.

15. The controller of claim 13, wherein the reference value comprises a pressure threshold not to be exceeded at the outlet.

* * * * *